US009414994B2

(12) United States Patent
Sjönell

(10) Patent No.: US 9,414,994 B2
(45) Date of Patent: Aug. 16, 2016

(54) DISPENSING DEVICE

(75) Inventor: Göran Sjönell, Lidingö (SE)

(73) Assignee: Mediratt AB, Lidingo (SE)

( * ) Notice: Subject to any disclaimer, the term of this patent is extended or adjusted under 35 U.S.C. 154(b) by 860 days.

(21) Appl. No.: 12/444,969

(22) PCT Filed: Oct. 4, 2007

(86) PCT No.: PCT/SE2007/050706
§ 371 (c)(1),
(2), (4) Date: Aug. 26, 2009

(87) PCT Pub. No.: WO2008/044990
PCT Pub. Date: Apr. 17, 2008

(65) Prior Publication Data

US 2010/0025417 A1 Feb. 4, 2010

(30) Foreign Application Priority Data

Oct. 10, 2006 (SE) ..... 0602131

(51) Int. Cl.
*G07F 11/00* (2006.01)
*B65B 59/00* (2006.01)
*A61J 7/04* (2006.01)

(52) U.S. Cl.
CPC ..... *A61J 7/0481* (2013.01); *A61J 7/0454* (2015.05)

(58) Field of Classification Search
USPC ..... 221/2, 3, 15, 25, 69, 89, 92, 103, 112, 221/113, 119–121, 133, 154, 208, 258, 277, 221/288
See application file for complete search history.

(56) References Cited

U.S. PATENT DOCUMENTS

| | | | | |
|---|---|---|---|---|
| 4,572,403 | A * | 2/1986 | Benaroya | 221/3 |
| 4,768,177 | A | 8/1988 | Kehr et al. | |
| 4,785,969 | A | 11/1988 | McLaughlin | |
| 6,145,697 | A * | 11/2000 | Gudish | 221/3 |
| 6,625,518 | B2 * | 9/2003 | Depeursinge | 700/242 |
| 7,159,720 | B2 * | 1/2007 | Pearson | 206/533 |
| 2002/0147526 | A1 | 10/2002 | Siegel | |
| 2002/0190075 | A1 * | 12/2002 | Weldi et al. | 221/69 |
| 2003/0006242 | A1 | 1/2003 | McKinney, Jr. et al. | |
| 2003/0127463 | A1 * | 7/2003 | Varis | 221/2 |
| 2004/0172163 | A1 | 9/2004 | Varis | |
| 2004/0182873 | A1 * | 9/2004 | Baum | 221/15 |

OTHER PUBLICATIONS

Office Action in corresponding European Patent Application No. 07835291.1-1651dated Jul. 4, 2014.

* cited by examiner

*Primary Examiner* — Gene Crawford
*Assistant Examiner* — Kelvin L Randall, Jr.
(74) *Attorney, Agent, or Firm* — Renner, Otto, Boisselle & Sklar, LLP

(57) ABSTRACT

The invention pertains to a time-controlled dispensing device comprising at least a tray and a cover, which may be lockable, for example via snap fitting, for consecutive dispensing of doses of medicaments. The device comprises a desired number of storage compartments and/or cartridges, for example disposable cartridges, each containing a predetermined dose of one or several medicaments. The tray is fitted with a transporting means for displacing the tray to a position where a desired compartment and/or cartridge will be in the only dispensing position suitable for removal of the dose, as a response to a signal from a timing means. The timing means is connected to a reminder and/or an alarming means, directed to the person using the device and a person at a distance, respectively. By way of the alarming means, removal of doses is indicated, for example through the manipulation of a lever or a hatch, and a signal may be sent for example via GSM or via the internet.

19 Claims, 2 Drawing Sheets

DISPENSING DEVICE

This application is a national phase of International Application No. PCT/SE2007/050706 filed Oct. 4, 2007 and published in the English language.

GENERAL DESCRIPTION

Timely medication of patients is pivotal and poses a considerable challenge to the medical society. Patients commonly forget to take their medicines, in particular elderly patients and those required to adhere to a complicated scheme of administration with several doses a day, sequentially, sometimes of different drugs as well. In fact, elderly patients who are most likely to forget medications are the ones most likely to stay on such a regime. In particular, patients medicated with five or more different medicaments are less likely to adhere to their medical regimen.

Since the pharmacodynamics of various drugs differs considerably, administration of drugs at specific times may be necessary or advisable, even more so when the risk of interactions is considered. Furthermore, doses may be cumulative if the time period between medications is insufficient, possibly leading to adverse effects.

The current invention relates to dispensing devices, and in particular lockable dispensing devices intended to dispense medicaments at pre-determined times, comprising reminder and alarming means.

The device in its most simple embodiment comprises a closed compartment consisting of a tray and a cover. A wall is connecting the tray with the cover, which may optionally be possible to lock. In the tray or in the side of the wall there is an aperture for accessing doses of medicaments.

The tray is divided into storage compartments or has a space to be filled with cartridges. Alternatively, cartridges may be placed in the storage compartments. The cartridges have a shape which enables them to be easily removed from the device and facilitates easy handling by a person with impaired motor skills. The size of the compartments and/or the cartridges is suitable for holding doses of one or several medicaments. The cartridges can advantageously hold compositions other than tablets, such as powders, liquids, syrups.

Displacement of the tray is achieved using a transporting means. The transporting means is comprised of a rack located underneath the tray or alternatively on the wall of the device, e.g. at the lower end of the wall adjacent to the tray. The tray is moved in position by way of an electric motor or mechanical propulsion device, which is via a gear wheel linked to the rack. If the transporting means comprises an electric motor, the motor may be connected to a battery or to a wall socket.

The aperture at the bottom of the device is in its simplest embodiment arranged just to drop the dose on e.g. a table or into a cup, and is optionally fitted with a hatch for accessing the medicaments in the storage compartment or cartridge located directly above the hatch. The hatch is optionally connected to a lever for easy handling.

The device is fitted with a timing means, which may be programmed (pre-set) and is responsible for displacing the tray at pre-set times, thus enabling dispensing of a pre-determined amount of medicaments. The timing means may be an ordinary watch. The timing means may be located under the cover, and thus impossible to manipulate once the lid has been closed, ensuring patient safety. Alternatively, the timing means may be pre-set through small apertures in the device, using a sharp object. According to yet another embodiment, signals may be transmitted via e.g. IP, GSM or Bluetooth to a computer, for programming of the dispensing device. This IP, GSM or Bluetooth communication may be one-way or two-way, hence either for programming the dispensing device and/or for transmitting the alarm signal.

The device may be provided with a reminder means. The reminder means is for example in the form of one or several of an acoustic or visual signal, or alternatively a vibrating motion, set off if medications are not removed from the device. In one embodiment, the reminder means is connected to the hatch, so that it is set off if the hatch is not opened. In another embodiment, a lever protruding against the cartridges is used as part of the reminder means. Thus, if the position of the lever is not manipulated from its position against the cartridge, the reminder means is set off.

For giving an indication of patient compliance, i.e. if the subject has removed medications from the device, at a distance, the device may be provided with an alarming means. The alarming means may be connected to either the hatch or the lever, or other connecting means. The alarming means may be a telephone connection, such as a GSM signal. Alternatively, signals may be sent via the internet. The alarming signal may be a signal that is sent after a deferred time interval, after the reminder means has been set off. Thereby, the patient has the possibility of removing the medicaments during a certain time interval, before the supervisor is noticed, ensuring an efficient procedure.

The aperture for removal of the doses of medicaments is in one embodiment located in the tray. In another embodiment, the aperture is located in the wall between the tray and the cover. Through the aperture, cartridges may be removed or storage compartments emptied. The doses may optionally be emptied into a cup or the like.

In one embodiment, the device is circular in shape with the compartments or cartridges filling out the volume from the center of the device. Alternatively, cartridges may fill out part of the volume, e.g. part of a sector of the circle. In another embodiment, the dispensing device comprises an extended row of compartments and/or cartridges.

According to one embodiment, the dispensing device may be fitted on a wall, whereby the medicaments would easily drop out of the dispensing device at the pre-set times by way of gravity. The device may be fitted with an integral cup for easy access to the medicaments. The hatch may then be located on the cup rather than on the cover.

In one embodiment, the open side of the compartments and/or cartridges may be encompassed by a movable "caterpillar track" with an aperture in one of the chain links, for accessing the medicaments. Alternatively, two or more rows of storage compartments and/or cartridges may be located side by side.

The dispensing device may be manufactured through for example an injection moulding technique. The device may be made out of transparent plastic, for easy identification of medicaments through the cover. Moreover, the device may be produced from a slightly elastic polymer to enable simple assemblage by way of snap fitting. The device may be constructed of a polymer that gives a surface which is easy to handle, with regard to for example elderly people. Alternatively, the device may be encompassed by such an easy-to-handle outer surface.

The device may as was mentioned above be closed by way of conventional fastening means, such as snap fitting, screws, bolts, optionally with a lock such as a padlock or a combination lock. The fastening means may be such that the device cannot again be opened once closed, i.e. the whole device would be tamperproof and hence disposable. The device could be loaded at e.g. a pharmacy and handed to the subject, ensuring patient safety.

The cartridges may be disposable and are e.g. made out of a polymeric material. The cartridges may be fitted with e.g. an aluminum or plastic foil, glued or heated to the open side of the cartridge. The foil improves handling of compositions other than tablets according to the description above, and may be easily removed by hand. In one embodiment, the device may be fitted with a mechanical device for making a hole in the foil, of a dimension sufficient to allow passage of the pre-filled medicaments.

In use, the device is pre-loaded with medicaments for more than one instance of administration, either by the patient himself or probably more commonly by a relative or professional staff such as caretakers or nurses. The device may alternatively be loaded at a pharmacy. After loading, the cover on the device may be locked, facilitating correct medication of the patient. Consequently, the patient has access to the medicaments only at specific, pre-determined times. This is an advantage not the least for dependence-producing medicaments that have an alternative market as substances of abuse and may thus be stolen or given away. The invention thus facilitates correct medication. Moreover, the alarm function has considerable value for dementia patients and other patients that may forget medications. More in particular, the invention is advantageous for patients being medicated several times a day, in which instance non-intentional non-compliance may easily occur.

The present invention will now be described with reference to the accompanying drawings. The embodiments shall merely be seen as an illustration of the spirit and scope of the current invention, and in no way whatsoever as a limitation.

DETAILED DESCRIPTION OF THE EMBODIMENTS

Figure 1:
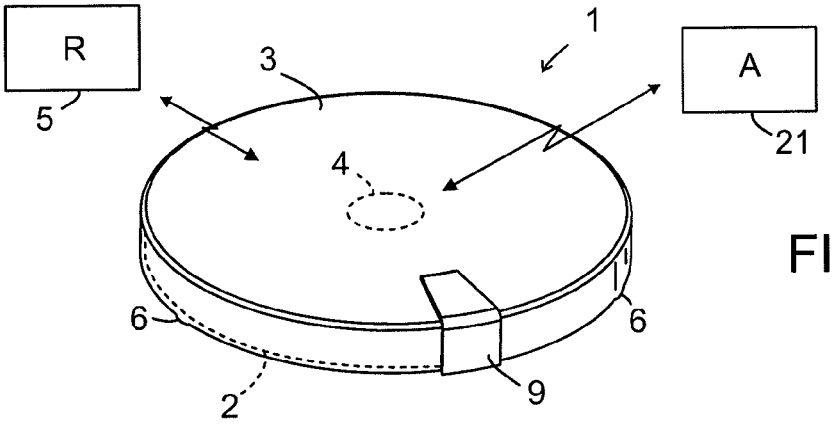
FIG. 1 is a perspective view of the top of one embodiment of the dispensing device according to the present invention showing the tray and the cover, the timing means, and the reminder/alarming means.

In one embodiment of the invention, as shown in FIG. 1, the dispensing device 1 includes a tray 2, a cover 3 and a timing means 4, which is connected to a reminder (5) and/or alarming means (21), via for example GSM, IP, Bluetooth. The timing means indicates via a reminder means when a medicament is to be taken. The timing means is in one embodiment located under the plastic cover, and hence is impossible to manipulate for the patient.

The cover is fitted to the tray by means of snap fitting 6.

Figure 2:
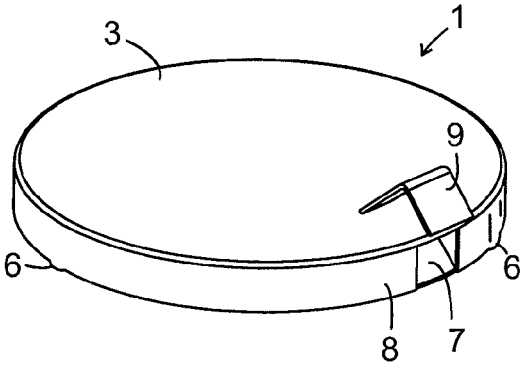
FIG. 2 is a perspective view of an embodiment of the present invention showing the aperture in the side wall of the dispensing device and the hatch.

The dispensing device is in the embodiment according to FIG. 2 fitted with an aperture 7 in the side wall 8 of the cover and a hatch 9. The hatch is manipulated by the person using the device, whereby the reminder means is reset until the timing means indicates the next time of administration. If the hatch is not manipulated, an alarm is sent off to for example a person at a distance, such as a nurse or a caretaker, for example via an internet connection.

Figure 3:
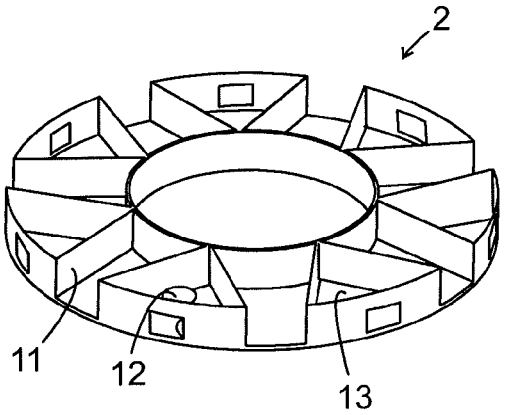
FIG. 3 is a perspective view of an embodiment of the present invention showing cartridges located on the tray.

The tray 2 in the device according to FIG. 3 is divided into compartments with dividing walls 11 in which the medicaments 12 are located. The cartridges 13 fill up the space of the compartments.

Figure 4:
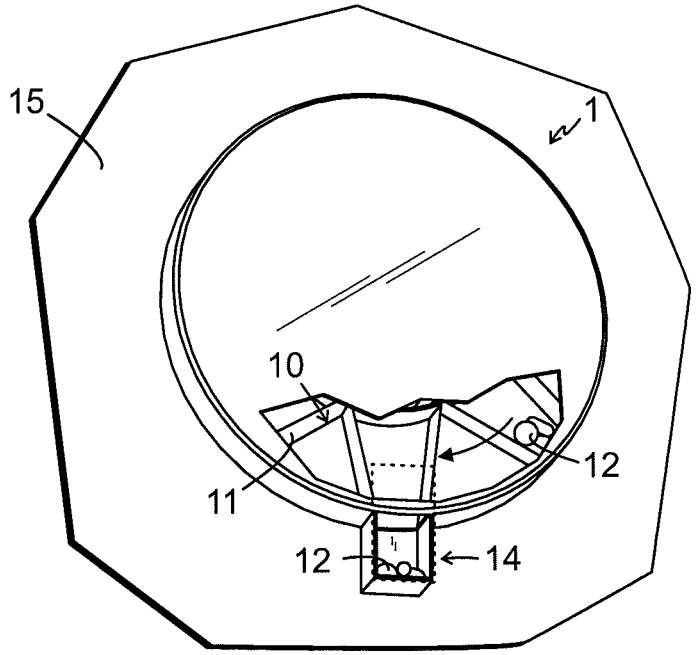
FIG. 4 is a side view of a wall mounted embodiment of the device according to the invention, showing medicaments easily leaving the device for the inherent cup for easy dispensing of drugs.

In FIG. 4 a cup 14 for example underneath the dispensing device 1 is shown. In use, when the present compartment 10 with dividing walls 11 is located directly above the aperture, and the hatch, the medicaments 12 easily make their way into the cup by way of manipulation of the hatch, for example via a lever (not shown). The cup is an integral part of the dispensing device, and is easily emptied. The embodiment in FIG. 4 shows the dispensing device being mounted on a board 15 for fixation on a wall in e.g. a home.

Figure 5:
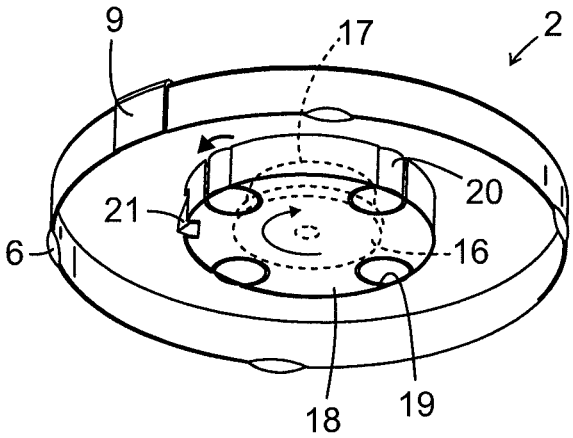
FIG. 5 is a view from the lower side of one embodiment of the propulsion device in the middle of the device comprising an electric motor, recesses and camming means for engaging the recesses with the rotatably mounted tray.

In one embodiment (not shown), the device is fitted with a transporting means, which includes a motor with a wheel which bears against a side wall of the device. In another embodiment according to FIG. 5, the transporting means consists of a propulsion device 16 which is coaxially connected to an electrical motor 17. The disc 18 in the center of the device is connected to the propulsion device and is fitted with recesses 19. These recesses engage with cams 20 that form part of the rotatably mounted tray. In another embodiment the propulsion is transmitted via a rack on the inner wall of the device, to which a motor is connected via a gear wheel (not shown). By way of the propulsion device, the tray is forwarded to a position in which the compartment may be emptied or the cartridge taken out. The tray is fitted with a detent means 21, whereby the tray cannot be manipulated once set in position. The detent means includes a locking device which engages with a gear ring to lock the tray in position until the propulsion device receives an indication from the timing means that the tray should be forwarded to the next position for administration of medicaments.

The invention claimed is:

1. A time-controlled dispensing device comprising at least a tray and a cover for consecutive dispensing of doses of medicaments, comprising (a) a desired number of pre-filled storage compartments and/or cartridges each containing one predetermined dose of one or several medicaments, said tray being fitted with a transport for displacing the tray to a position where a desired compartment and/or cartridge will be in the only dispensing position suitable for removal of the dose from the compartment and/or the cartridge, (b) a timer connected to the transport for controlling the transport of the tray in (a) at predetermined time intervals;

(c) a reminder device directed to the person using the device, and/or (d) an alarm indicating at a distance that removal of the dose has or has not occurred;

wherein the dispensing device is configured for mounting to a wall, whereby the medicaments could easily drop out of the dispensing device at pre-set times by way of gravity, and wherein the reminder device and/or the alarm is triggered respectively by nonmovement of a lever and/or a hatch dependent on the removal or not of the dose.

2. The dispensing device according to claim 1, wherein the cover of the dispensing device has a lock.

3. The dispensing device according to claim 1, characterized in the lock comprising a snap fitting.

4. The dispensing device according to claim 1, wherein the transport comprises an electric motor or a mechanical propulsion device connected to the tray of the dispensing device.

5. The dispensing device according to claim 1, wherein the alarm comprises a GSM signal or a signal via internet.

6. The dispensing device according to claim 1, wherein the reminder device comprises one or several of an acoustic or visual signal or a vibrating motion.

7. The dispensing device according to claim 1, comprising a detent for locking the tray in a fixed position when the tray is not displaced to a new position.

8. The dispensing device according to claim 1, comprising the cartridge, and wherein the cartridge is a disposable cartridge.

9. The dispensing device according to claim 1, mounted on a wall.

10. A time-controlled dispensing device comprising at least a tray and a cover for consecutive dispensing of doses of medicaments, comprising:

(a) a plurality of pre-filled storage compartments and/or cartridges each configured to contain one predetermined dose of one or several medicaments, said tray being fitted with a transport for displacing the tray to a position where a desired compartment and/or cartridge will be in the only dispensing position suitable for removal of the dose from the compartment and/or the cartridge;

(b) a timer connected to the transport for controlling the transport of the tray in (a) at predetermined time intervals;

(c) a reminder device directed to the person using the device; and (d) an alarm indicating at a distance that removal of the dose has or has not occurred after a predetermined time lapse;

wherein the dispensing device is configured for mounting to a wall, whereby the medicaments could easily drop out of the dispensing device into a cup extending from the cover at pre-set times by way of gravity, and wherein the reminder device and the alarm is triggered respectively by nonmovement of a lever and/or a hatch dependent on the removal or not of the dose.

11. The dispensing device according to claim 10, wherein the tray is mounted for rotation about a central axis.

12. The dispensing device according to claim 10, wherein the cover comprises a shroud circumferentially surrounding the tray and configured to prevent the medicaments from exiting the tray.

13. The dispensing device according to claim 12, wherein the shroud includes an opening configured to allow passage of medicaments from one of the plurality of pre-filled storage compartments and/or cartridges.

14. The dispensing device according to claim 13, wherein the opening connects the one of the plurality of pre-filled storage compartments and/or cartridges with a cup for receiving dispensed medicaments, the cup is positioned radially outward of the tray and includes the lever and/or hatch.

15. The dispensing device according to claim 14, wherein the cup is integral with the shroud.

16. The dispensing device according to claim 10, wherein the alarm comprises a GSM signal or a signal via internet.

17. The dispensing device according to claim 10, wherein the reminder device comprises one or several of an acoustic or visual signal or a vibrating motion.

18. The dispensing device according to claim 10, wherein the reminder device comprises one or several of an acoustic or visual signal or a vibrating motion and wherein the alarm comprises a GSM signal or a signal via internet.

19. A time-controlled dispensing device for consecutive dispensing of doses of medicaments, comprising:

a tray mounted for rotation about a central axis;

a cover including a shroud circumferentially surrounding the tray and configured to prevent the medicaments from exiting the tray, the shroud having an opening configured to allow passage of medicaments from one of a plurality of pre-filled storage compartments and/or cartridges;

the plurality of pre-filled storage compartments and/or cartridges each configured to contain one predetermined dose of one or several medicaments, said tray being fitted with a transport for displacing the tray to a position where a desired compartment and/or cartridge will be in the only dispensing position suitable for removal of the dose from the compartment and/or the cartridge;

a timer connected to the transport for controlling the transport of the tray at predetermined time intervals;

a reminder device comprising one or several of an acoustic or visual signal or a vibrating motion, the reminder device directed to the person using the device and indicating a medicament has been dispensed; and an alarm comprising a GSM signal or a signal via internet, the alarm indicating at a distance that removal of the dose has or has not occurred after a predetermined time lapse, wherein the dispensing device is configured for mounting to a wall, whereby the medicaments could easily drop out of the tray at pre-set times by way of gravity, and wherein the reminder device and the alarm is triggered respectively by nonmovement of a lever and/or a hatch dependent on the removal or not of the dose, wherein the opening connects the one of the plurality of pre-filled storage compartments and/or cartridges with a cup for receiving dispensed medicaments, the cup is positioned radially outward of the tray and includes the lever and/or hatch.

* * * * *